US007879522B2

(12) United States Patent
Aga et al.

(10) Patent No.: US 7,879,522 B2
(45) Date of Patent: Feb. 1, 2011

(54) CARRIER CORE MATERIAL FOR ELECTROPHOTOGRAPHIC DEVELOPER, CARRIER AND ELECTROPHOTOGRAPHIC DEVELOPER USING THE CARRIER

(75) Inventors: Koji Aga, Chiba (JP); Issei Shinmura, Ibaraki (JP); Tetsuya Igarashi, Chiba (JP)

(73) Assignee: Powdertech Co., Ltd., Kashiwa-shi (JP)

( * ) Notice: Subject to any disclaimer, the term of this patent is extended or adjusted under 35 U.S.C. 154(b) by 118 days.

(21) Appl. No.: 12/362,571

(22) Filed: Jan. 30, 2009

(65) Prior Publication Data

US 2009/0197194 A1 Aug. 6, 2009

(30) Foreign Application Priority Data

Jan. 31, 2008 (JP) ..... 2008-020030

(51) Int. Cl.
*G03G 9/083* (2006.01)

(52) U.S. Cl. ..... 430/111.34; 430/111.1

(58) Field of Classification Search ..... 430/111.34, 430/111.1

See application file for complete search history.

(56) References Cited

U.S. PATENT DOCUMENTS

| | | | |
|---|---|---|---|
| 6,294,304 | B1 | 9/2001 | Sukovich et al. |
| 2004/0229151 | A1 | 11/2004 | Kobayashi et al. |
| 2009/0130587 | A1 | 5/2009 | Kayamoto et al. |

FOREIGN PATENT DOCUMENTS

| | | |
|---|---|---|
| JP | 62-50839 | 3/1987 |
| JP | 2000-233930 | 8/2000 |
| JP | 2004-053643 | 2/2004 |
| JP | 2004-191834 | 7/2004 |
| JP | 2004-240321 | 8/2004 |
| JP | 2004-279883 | 10/2004 |
| WO | 2007-063933 | 6/2007 |

*Primary Examiner*—Hoa V Le
(74) *Attorney, Agent, or Firm*—Greenblum & Bernstein, P.L.C.

(57) ABSTRACT

There are adopted: a carrier core material for an electrophotographic developer, including Mg, Ti and Fe as main components, and containing Fe, Mg and Ti in contents of 52 to 66% by weight, 3 to 12% by weight and 0.2 to 12% by weight, respectively; an electrophotographic developer carrier prepared by coating with a resin the surface of the carrier core material; and an electrophotographic developer using the carrier.

19 Claims, No Drawings

CARRIER CORE MATERIAL FOR ELECTROPHOTOGRAPHIC DEVELOPER, CARRIER AND ELECTROPHOTOGRAPHIC DEVELOPER USING THE CARRIER

BACKGROUND OF THE INVENTION

1. Field of the Invention

The present invention relates to a carrier core material for an electrophotographic developer, used in a two-component electrophotographic developer used in apparatuses such as copying machines and printers, a carrier and an electrophotographic developer using the carrier.

2. Description of the Related Art

An electrophotographic development method is a method in which development is conducted by adhering the toner particles in a developer to the electrostatic latent image formed on a photoreceptor, and the developer used in such a method is classified into a two-component developer composed of toner particles and carrier particles and a one-component developer using only toner particles.

As a development method using a two-component developer composed of toner particles and carrier particles, among such developers, previously a method such as a cascade method has been adopted, but currently a magnetic brush method using a magnet roll predominates.

In a two-component developer, the carrier particles serve as a carrying substance to form a toner image on the photoreceptor in such a way that the carrier particles are stirred together with the toner particles in a developer box filled with the developer to impart a desired charge to the toner particles, and further, convey the thus charged toner particles to the surface of the photoreceptor to form the toner image on the photoreceptor. The carrier particles remaining on a development roll which holds a magnet again return from the development roll to the developer box to be mixed and stirred with the fresh toner particles to be repeatedly used for a predetermined period of time.

In contrast to a one-component developer, a two-component developer is such that the carrier particles are mixed and stirred with the toner particles, thus charge the toner particles, and further have a function to convey the toner particles, and a two-component developer is excellent in the controllability in designing developers. Accordingly, two-component developers are suitable for full-color development apparatuses required to offer high image quality and for high speed printing apparatuses required to be satisfactory in the reliability and durability in image maintenance.

In two-component developers used in the above-described manner, the image properties such as the image density, fogging, white spot, gradation and resolution are each required to exhibit a predetermined value from the initial stage, further these properties are required to be invariant and to be stably maintained during the endurance printing. For the purpose of stably maintaining these properties, necessary is the stability of the properties of the carrier particles contained in the two-component developers.

As the carrier particles which form two-component developers, there have hitherto been used iron powder carriers such as an iron powder carrier in which the surface of an iron powder is coated with an oxide coating film or a resin. Such iron powder carriers are high in magnetization and also high in conductivity, and hence have an advantage that images satisfactory in the reproducibility of the solid print portions thereof are easily obtained.

However, the true specific gravities of such iron powder carriers are as heavy as approximately 7.8, and the magnetizations of such iron power carriers are too high. Accordingly, the stirring and mixing of such an iron powder carrier with the toner particles in the developer box tend to cause the fusion bonding of the toner-constituting components to the surface of the iron powder carrier, namely, the so-called toner spent condition. The occurrence of such a toner spent condition reduces the effective surface area of the carrier, and the triboelectric charging ability of the carrier in relation to the toner particles tends to be degraded.

Additionally, in the resin-coated iron powder carrier, the resin on the surface is exfoliated by the stress at the time of endurance to expose the core material (iron powder) which is highly conductive and low in dielectric breakdown voltage, and accordingly the charge leakage occurs as the case may be. Such charge leakage breaks the electrostatic latent image formed on the photoreceptor, causes brush strokes or the like to occur on the solid print portion, and makes it difficult to obtain a uniform image. Due to these reasons, currently the iron powder carriers such as oxide film-coated iron powder carriers and resin-coated iron powder carriers have become decreasingly used.

In these years, in place of the iron powder carriers, ferrites each having a true specific gravity of as light as approximately 5.0 and being low in magnetization are used as carriers, and further, resin-coated ferrite carriers in each of which the surface of the ferrite is coated with a resin are frequently used, and accordingly the operating lives of the developers have been dramatically extended.

As methods for producing such ferrite carriers, in general, a ferrite carrier raw material is mixed in a predetermined amount, thereafter calcined, pulverized and granulated, and thereafter sintered; the calcination may be omitted depending on the conditions involved.

However, such methods for producing ferrite carriers suffer from various problems. Specifically, the sintering step of generating magnetization by ferritization reaction generally uses a tunnel kiln to sintere a raw material filled in a saggar, and hence, due to the inter-particle effects, the ferrite particles tend to be irregular in shape; in particular, the irregularity is the more remarkable for the smaller particles; thus, after sintering, particles are block shaped, and when the blocks are disintegrated, cracking and chipping occur to result in commingling of irregular particles. Additionally, when a small-size ferrite particle is produced, enhanced pulverization is essential for production of satisfactorily shaped particles. Furthermore, problematically, the sintering time is required to be approximately 12 hours inclusive of a period for increasing the temperature, a period for maintaining the maximum temperature and a period for decreasing the temperature; and in addition, after sintering, disintegration of the block-shaped material is needed, and thus the production stability is not satisfactory.

Additionally, the carrier core materials produced by means of such a sintering method as described above include abundantly irregular particles due to particle deformation in addition to cracked and chipped particles, and hence the formation of a resin coating film also finds it difficult to form a uniform coating film. The resin coating film becomes thicker in the recessed portions on the particle surface and becomes thinner in the raised portions on the particle surface. The portions where the thickness of the resin coating film is thinner are earlier, due to the stress, in exposing the carrier core material and becomes the causes for the leakage phenomenon and the broadening of the charge amount distribution, and thus, it has been difficult to stabilize high image qualities over a long period of time.

For the purpose of preventing the cracking and chipping, and reducing the proportion of the irregular particles, it is necessary to prevent the mutual aggregation of the particles at the time of sintering. When the particles are sintered at a lower sintering temperature for the purpose of preventing such aggregation, the stress at the time of the disintegration after sintering becomes smaller and the proportion of the cracked and chipped particles and the proportion of the irregular particles and the like can be reduced.

However, in this case, the surface property of the particles becomes porous, the resin impregnation or the like degrades the charging rise, and the amount of the resin in the impregnated portions, namely, the amount of the resin unnecessarily consumed becomes larger, and this case is poor in economic efficiency and is not desirable from both quality and cost.

For the purpose of solving such problems, a new method for producing a ferrite carrier has been proposed. For example, Japanese Patent Laid-Open No. 62-50839 describes a method for producing a ferrite carrier in which a mixture composed of metal oxides mixed therein as the raw materials for the ferrite is made pass through a high temperature flame atmosphere, and thus the mixture is instantly ferritized.

However, in this production method, the production is conducted with a ratio of the oxygen amount to the fuel gas of 3 or less, and accordingly, the sintering becomes difficult depending on the ferrite raw materials. Additionally, in the production of a ferrite having a small particle size of, for example, approximately 20 to 50 μm, to meet the recent trend of particle size reduction of carriers, the heat amounts applied to the individual particles are possibly different from each other, no sufficient heat is possibly applied to the interior of the relatively larger particles having a particle size of 50 μm or more, and thus, in either case, no spherical and uniform ferrite particles are obtained.

Additionally, International Publication No. 2007-63933 describes a method for producing a resin-coated ferrite carrier in which a thermal spray method as described above is used, a combustion gas and oxygen are used for the flammable gas combustion flame, and the volume ratio of the combustion gas to oxygen is set at 1:3.5 to 1:6.0; the resin-coated ferrite carrier thus produced is stated such that the surface of the carrier core material is provided with irregularities which form a thin stripe-like wrinkle pattern to improve the adhesion strength of the surface of the carrier core material to the resin coating film.

This International Publication No. 2007-63933 states that various ferrite compositions can be used as the ferrite compositions used as the carrier core materials; however, as is clear from the examples presented therein, the ferrite composition disclosed as the carrier core material is limited to a Mn—Mg—Sr ferrite.

On the other hand, in these years, the environmental regulations become strict, the use of metals such as Ni, Cu and Zn has come to be avoided, and the use of the metals adaptable to the environmental regulations is demanded. Thus, the ferrite compositions used as the carrier core materials are changing over from the Cu—Zn ferrite and the Ni—Zn ferrite to the ferrites using Mn such as the Mn ferrite and the Mn—Mg—Sr ferrite.

However, Mn is also becoming the objects of various legal regulations, and carrier core materials which do not use Mn as well as the above-described various heavy metals are demanded.

On the other hand, as the ferrite composition free from the use of Mn, various proposals have been made on the compositions such as a Li—Mg—Ca ferrite and a Mg ferrite, but these compositions are still unfamiliar. As a reason for this, for example, it is known that the ferrite carrier using Li as a carrier core material undergoes large variations of the charge amount and the resistivity due to the effect of a slight amount of moisture in the air even when the surface of the carrier is coated with a resin. Additionally, the Mg ferrite requires, as a prerequisite, a sintering under a controlled atmosphere, depending on the addition amount of Mg, for the purpose of attaining satisfactory properties; thus, it is extremely difficult to produce the Mg ferrite when only equipment for sintering in the atmosphere is available.

Japanese Patent Laid-Open Nos. 2004-279883, 2004-191834 and 2004-53643 propose electrophotographic developer carriers including ferrite compositions using rare earth metals such as Dy, Tb and Gd, respectively, without using Mn.

These carriers do not use Mn, but each use a rare earth metal; such rare earth metals are hardly available and high in price, and hence are difficult to use for industrial applications.

Japanese Patent Laid-Open No. 2000-233930 describes the inclusion of Ti for the purpose of stabilizing the spinel phase, but the addition of Ti is not for the purpose of positively controlling the magnetization.

Japanese Patent Laid-Open No. 2004-240321 describes the incorporation of an element such as Ti so as to be present in a ferrite as a single oxide, but this incorporation is not for the purpose of controlling the magnetization by producing a composite oxide including Fe and Ti, other than the spinel.

As described above, demanded are: a carrier core material which, without using Mn as well as various heavy metals, attains desired properties, in particular, attains a desired resistivity in combination with a low magnetization, has a coercive force of the order of magnitude not to affect the fluidity, and has a satisfactory fluidity; a carrier; and an electrophotographic developer using the carrier.

SUMMARY OF THE INVENTION

Accordingly, an object of the present invention is to provide: a carrier core material for an electrophotographic developer which, without using Mn as well as various heavy metals, attains a desired resistivity in combination with a low magnetization, has a coercive force of the order of magnitude not to affect the fluidity, has a satisfactory fluidity and prevents the carrier adhesion when incorporated in a developer; a carrier; and an electrophotographic developer using the carrier.

For the purpose of solving such problems as described above, the present inventors made a diligent study, and reached the present invention by discovering that a carrier core material, including Mg, Ti and Fe as main components, each in a predetermined amount, and a carrier prepared by coating the carrier core material with a resin can attain the above-described object. Additionally, the present inventors discovered that such a carrier core material can be produced by passing thorough a step of thermal spraying.

In particular, in the present invention, a magnetization regulation is made, to some extent, on the basis of high-magnetization (95 $Am^2/kg$) $Fe_3O_4$ (magnetite) and low-magnetization (35 $Am^2/kg$) $MgOFe_2O_3$ (magnesium ferrite); the difference from an intended magnetization is coped with by incorporating an almost null-magnetization (0 $Am^2/kg$) composition $Fe_2TiO_5$ or $FeTiO_3$; and thus, the desired magnetic property (magnetization) can be developed.

Additionally, the sintering by thermal spraying extremely shorter in sintering time than conventional sintering methods; even when magnesium ferrite is sintered by thermal spraying with a stoichiometric ratio, Mg is not sufficiently ferritized with Fe in such a way that Fe becomes superfluous and is converted into $Fe_3O_4$ (magnetite), and consequently, the magnetization becomes high.

On the other hand, the carrier core material for an electrophotographic developer low both in resistivity and in magnetization was not able to be produced by using conventional methods and compositions; however, it has been found that by producing a Mg—Ti composition by means of thermal spraying, a low-resistivity and low-magnetization carrier core material is able to be obtained.

The incorporation of the above-described three crystal structures allows optional selection of the combinations of the individual crystal structures even for one and the same magnetization as a magnetic property, and such allowance advantageously serves for the controllability of the resistivity. In other words, it has been discovered that by regulating the balance between Fe, Ti and Mg, the resistivity and the magnetic properties can be varied, for example, in such a way that the magnetization is not significantly varied between before and after the surface oxidation to increase the resistivity, or in such a way that the magnetization can be drastically varied between before and after the surface oxidation, and hence a broader selectivity for the relation between the magnetization and the resistivity can be acquired than in conventional carrier core materials. The present invention has been achieved on the basis of these discoveries.

Specifically, the present invention provides a carrier core material for an electrophotographic developer, including Mg, Ti and Fe as main components, and containing Fe, Mg and Ti in contents of 52 to 66% by weight, 3 to 12% by weight and 0.2 to 12% by weight, respectively.

The carrier core material for an electrophotographic developer according to the present invention is preferably such that the saturation magnetization as measured with a VSM at 1 kOe is 30 to 60 $Am^2/kg$, the remanent magnetization is 2 to 4 $Am^2/kg$ and the coercive force is 25 to 75 Oe.

The carrier core material for an electrophotographic developer according to the present invention is preferably truly spherical in shape.

The carrier core material for an electrophotographic developer according to the present invention is preferably such that when the bridge electric resistivity values for a 6.5-mm gap at applied voltages of 100 V and 500 V are respectively represented by $R_{100}$ and $R_{500}$, $R_{100}$ is $5\times10^6$ to $1\times10^{10}\Omega$ and $R_{500}$ is $5\times10^6$ to $1\times10^{10}\Omega$.

The carrier core material for an electrophotographic developer according to the present invention is preferably such that the volume average particle size $D_{50}$ as measured with a laser diffraction particle size distribution analyzer is 20 to 100 μm.

The carrier core material for an electrophotographic developer according to the present invention preferably includes 0 to 5% by volume of particles of 16 μm or less in the volume particle size distribution as measured with a laser diffraction particle size distribution analyzer.

The carrier core material for an electrophotographic developer according to the present invention is preferably such that the apparent density measured according to JIS Z2504 (test method for apparent density of metal powders) is 2.4 to 2.7 $g/cm^3$.

The carrier core material for an electrophotographic developer according to the present invention is preferably such that the fluidity measured according to JIS Z2502 (test method for fluidity of metal powders) is 20 to 75 sec/50 g.

The carrier core material for an electrophotographic developer according to the present invention is preferably such that an oxide coating film is formed on the surface of the carrier core material.

Additionally, the present invention provides an electrophotographic developer carrier prepared by coating the carrier core material with a resin.

Yet additionally, the present invention provides an electrophotographic developer including the carrier and a toner.

The carrier core material for an electrophotographic developer and the carrier according to the present invention, without using heavy metals including Mn as well as various heavy metals, each attain a desired resistivity in combination with a low magnetization, have a coercive force of the order of magnitude not to affect the fluidity and have a satisfactory fluidity. And, the electrophotographic developer using the carrier prevents the carrier adhesion.

DETAILED DESCRIPTION OF THE PREFERRED EMBODIMENTS

Hereinafter, the best mode for carrying out the present invention is described.

<Carrier Core Material for an Electrophotographic Developer According to the Present Invention>

The carrier core material for an electrophotographic developer according to the present invention includes Mg, Ti and Fe as main components, and contains Fe in a content of 52 to 66% by weight, preferably 53.5 to 65% by weight and more preferably 55 to 65% by weight, contains Mg in a content of 3 to 12% by weight, preferably 3 to 10% by weight and more preferably 3 to 8% by weight, and contains Ti in a content of 0.2 to 12% by weight, preferably 0.35 to 10% by weight and more preferably 0.5 to 9% by weight. In the above-described composition ranges, the carrier core material attains a desired resistivity in combination with a low magnetization, has a coercive force of the order of magnitude not to affect the fluidity and has a satisfactory fluidity.

In particular, the inclusion of Ti, needless to say, attains desired magnetic properties, and additionally enables to increase the coercive force within a range not to affect the fluidity. In general, triboelectric charging is caused by mutual friction between different substances with an appropriate stress, and simple excellence exclusively in fluidity results in poor charging ability; however, the carrier using the carrier core material according to the present invention enables to conduct triboelectrical charging because the carrier concerned is large in coercive force while maintaining the fluidity in an extremely satisfactory condition, and the carrier is stirred with the toner under an application of an appropriate stress in a developing device.

The Fe content of less than 52% by weight means that the addition amount of Mg and/or Ti is relatively increased to increase the nonmagnetic component and/or the low magnetization component, and hence no desired magnetic properties are obtained; the Fe content exceeding 66% by weight does not attain the effects of the addition of Mg and/or Ti and results in a carrier core material substantially equivalent to magnetite. The Mg content of less than 3% by weight decreases the production amount of the magnesium ferrite phase in the carrier core material and relatively increases the production amount of the magnetite phase to increase the coercive force, and hence results in a possibility that no desired magnetic properties are obtained; the Mg content exceeding 12% by weight produces magnesium oxide in addition to the magnesium ferrite in the carrier core material, and hence results in a possibility that no desired magnetic properties are obtained. The Ti content of less than 0.2% by weight decreases the production amount of the composite oxide between Fe and Ti is small, and hence results in a possibility that no desired magnetic properties are obtained; the Ti content exceeding 12% by weight makes predominant the nonmagnetic phase due to the composite oxide between Fe and Ti to cause a too low magnetization, and hence results in a possibility that no desired magnetic properties are obtained. The contents of Fe, Mg and Ti are measured in the following manner.

(Contents of Fe, Mg and Ti)

A carrier core material is weighed out in an amount of 0.2 g, a solution prepared by adding 20 ml of 1N hydrochloric acid and 20 ml of 1N nitric acid to 60 ml of pure water is heated, the carrier core material is completely dissolved in the solution to prepare an aqueous solution, and the contents of Fe, Mg and Ti are measured with an ICP analyzer (ICPS-10001V, manufactured by Shimadzu Corp.).

The carrier core material for an electrophotographic developer according to the present invention is preferably such that the saturation magnetization as measured with a VSM at 1 kOe is 30 to 60 $Am^2/kg$, the remanent magnetization is 2 to 4 $Am^2/kg$ and the coercive force is 25 to 75 Oe.

When the saturation magnetization is smaller than 30 $Am^2/kg$, the carrier scattering tends to occur and offers a cause for drum scratches and results in a possibility that adverse effects such as white spots are exerted on the image quality. When the saturation magnetization is larger than 60 $Am^2/kg$, the ears of the developer formed on a magnetic brush tend to be high and additionally sparse, to offer a possibility of degrading the image quality.

When the remanent magnetization is smaller than 2 $Am^2/kg$, no sufficient stirring stress is exerted in the developing device so as to inhibit sufficient charging of the toner. When the remanent magnetization is larger than 4 $Am^2/kg$, the fluidity of the developer in the developing device is poor to offer a possibility of occurrence of a drawback that the developer cannot be satisfactorily mixed.

Additionally, when the coercive force is smaller than 25 Oe, no sufficient stirring stress is exerted in the developing device so as to inhibit sufficient charging of the toner. When the coercive force is larger than 75 Oe, the fluidity in a magnetic field is significantly poor, and no successful development may probably be carried out. These magnetic properties are measured in the following manner.

A vibrating sample magnetometer (model VSM-C7-10A, manufactured by Toei Industry Co., Ltd.) is used. A measurement sample is filled in a cell of 5 mm in inner diameter and 2 mm in height to be set in the above-described apparatus. In the measurement, a magnetic field is applied and the magnetic field is scanned up to a maximum of 1 kOe. Then, the applied magnetic field is decreased, and thus a hysteresis loop is depicted on a sheet of recording paper. From the data provided by this loop, the magnetization is derived.

The carrier core material for an electrophotographic developer according to the present invention is preferably truly spherical in shape. A truly spherical shape as referred to herein means a shape of an average sphericity ratio of 1 to 1.2, preferably 1 to 1.1 and more preferably limitlessly close to 1. When the average sphericity ratio exceeds 1.2, the sphericity of the carrier core material is impaired. The carrier core material for an electrophotographic developer according to the present invention is truly spherical in shape, and hence is excellent in fluidity even when densely clogging the magnetic brush, and is small in exerting stress on the toner in the stirring in the developing device, and additionally stress is scarcely exerted on the carrier. Such alleviation of the stress exerted on the carrier leads to an advantage that the cracking and chipping of the carrier to cause image defects scarcely occur.

The average sphericity ratio as referred to herein is derived as follows: the images of a sample are photographed with a SEM at a magnification of 300 in such a way that the microscopic filed is varied so as to be able to count 100 or more particles in total; the photographed SEM images are scanned with a scanner and are subjected to an image analysis with an image analysis software "image-Pro PLUS" manufactured by Media Cybernetics Inc. to derive the circumscribed circle diameter and the inscribed circle diameter for each of the particles; and the ratio between these two diameters is defined as the sphericity ratio. The average sphericity ratio is 1 when these two diameters are the same, and is also 1 for a truly spherical case. The average sphericity ratio is defined by the average value derived by averaging the values obtained for 100 particles.

The carrier core material for an electrophotographic developer according to the present invention is preferably such that when the bridge electric resistivity values for a 6.5-mm gap at applied voltages of 100 V and 500 V are respectively represented by $R_{100}$ and $R_{500}$, $R_{100}$ is $5\times10^6$ to $1\times10^{10}\Omega$ and $R_{500}$ is $5\times10^6$ to $1\times10^{10}\Omega$. The case where $R_{100}$ is less than $5\times10^6\Omega$ is not preferable, because the resistivity is too low, and the carrier scattering occurs when the carrier core material is used for the carrier, to offer a cause for the image defects such as white spots. The case where $R_{100}$ exceeds $1\times10^{10}\Omega$ raises a fear that the resistivity of the developer is too high when the carrier core material is used for the carrier, no sufficient development current is obtained and no proper image density is attained in a halftone mode.

The case where $R_{500}$ is less than $5\times10^6\Omega$ is not preferable, because the resistivity is too low, and the carrier scattering occurs when the carrier core material is used for the carrier, to offer a cause for the image defects such as white spots. The case where $R_{500}$ exceeds $1\times10^{10}\Omega$ raises a fear that the resistivity of the developer is too high when the carrier core material is used for the carrier, no sufficient development current is obtained and no proper image density is attained in the solid print portion. The electric resistivity of the carrier core material is measured in the following manner.

(Electric Resistivity)

The nonmagnetic parallel plate electrodes (10 mm×40 mm) are made to face each other with an inter-electrode gap of 6.5 mm, and a sample weighed out to be 200 mg is filled between the electrodes. A magnet (surface magnetic flux density: 1500 Gauss, the area of the magnet in contact with each of the electrodes: 10 mm×30 mm) is fixed to the parallel plate electrodes to hold the sample between the electrodes, the voltages of 50 to 1000 V are applied sequentially, and the resistivity at each of the applied voltages is measured with an insulation resistivity meter (SM-8210, manufactured by Toa DKK Co., Ltd.). It is to be noted that the measurement is conducted in a constant-temperature and constant-humidity room set at a room temperature of 25° C. and a humidity of 55%.

In the carrier core material for an electrophotographic developer according to the present invention, the volume average particle size $D_{50}$ as measured with a laser diffraction particle size distribution analyzer is preferably 20 to 100 μm, more preferably 20 to 90 μm and most preferably 20 to 80 μm. The case where the volume average particle size is less than 20 μm is not preferable, because the carrier adhesion tends to occur. The case where the volume average particle size exceeds 100 μm is not preferable, because the image quality tends to be deteriorated. The volume average particle size is measured in the following manner.

(Volume Average Particle Size and Volume Particle Size Distribution)

Used as an apparatus is Microtrac Particle Size Analyzer (model 9320-X100) manufactured by Nikkiso Co., Ltd. The refractive index is set at 2.42 and the measurement is made in an environment of 25±5° C. and a humidity of 55±15%. The average particle size (median diameter) as referred to herein means a particle size at 50% accumulation in the volume distribution mode in under-sieve representation. The dispersion of a carrier sample is conducted by using as a dispersing liquid a 0.2% aqueous solution of sodium hexametaphosphate, as a one-minute ultrasonic treatment with an ultrasonic homogenizer (model UH-3C) manufactured by Ultrasonic Engineering Co., Ltd.

The carrier core material for an electrophotographic developer according to the present invention preferably includes 0 to 5% by volume of particles of 16 μm or less in the volume particle size distribution as measured with a laser diffraction particle size distribution analyzer. When the volume percentage is larger than 5% by volume, the fluidity is extremely aggravated even if the carrier core material is truly spherical in shape, too large stress is exerted on the developer to break the toner present in the developer, and there is raised a fear that no satisfactory image can be obtained.

The carrier core material for an electrophotographic developer according to the present invention is preferably such that the apparent density measured according to JIS Z2504 (test method for apparent density of metal powders) is 2.4 to 2.7 g/cm$^3$. When the apparent density is smaller than 2.4 g/cm$^3$, the magnetic force possessed by one particle is small, and hence such an apparent density possibly offers a cause for the carrier scattering. The case where the apparent density is larger than 2.7 g/cm$^3$ is not preferable because such an apparent density increases the weight of the carrier adhered to the magnetic brush, to result in an overloading to the motor for rotating the magnetic brush.

The carrier core material for an electrophotographic developer according to the present invention is preferably such that the fluidity measured according to JIS Z2502 (test method for fluidity of metal powders) is 20 to 75 sec/50 g. The case where the fluidity is less than 20 sec/50 g cannot be realized even with the contents of the present invention. When the fluidity is larger than 75 sec/50 g, the fluidity is extremely poor and is extremely aggravated even if the carrier core material is truly spherical in shape, too large stress is exerted on the developer to break the toner present in the developer, and there is raised a fear that no satisfactory image can be obtained.

(X-ray Diffraction Measurement)

Used as a Measurement Apparatus is "X'PertPRO MPD" manufactured by Panalytical Co., Ltd. A Co X-ray tube (Co Kα ray) as an X-ray source and a focusing optical system as an optical system, and a fast detector "X'celarator" as a detector are used, and the measurement is conducted with a step scan of 0.020. The measurement results are subjected to data processing by using an analysis software "X'Pert HighScore" in the same manner as in the usual crystal structure analysis of powders, and thus the crystal structures present in a core material are identified. It is to be noted that measurement can also be conducted with a Cu X-ray tube as an X-ray source without any problem; however, in the case where the sample contains Fe abundantly, the background is higher as compared to the peaks to be the measurement targets when a Cu X-ray tube is used, and hence a Co X-ray tube is preferable. Additionally, as for the optical system, a parallel optical system may also yield the same results, but the peak widths tend to be broadened to raise a fear of aggravating the measurement accuracy, and hence a focusing optical system is preferable. Further, the count time at each point in the step scan is set so as for the peak intensity of the most intense peak to be approximately 50000 cps. In particular, as for the intensity, a fast detector is preferably used for the purpose of reducing the measurement time.

The carrier core material for an electrophotographic developer according to the present invention is, as described below, produced by passing though a step of thermal spraying, and preferably the flame temperature of the burner is 1500 to 3000° C. and the flame passage time is within 10 seconds.

The carrier core material for an electrophotographic developer according to the present invention is preferably subjected to an oxidation treatment of the surface thereof. The thickness of the oxide coating film formed by the oxidation treatment is preferably 0.1 nm to 5 μm. When the thickness is less than 0.1 nm, the advantageous effect of the oxide coating film is small, and when the thickness exceeds 5 μm, the magnetization tends to be decreased and the resistivity tends to be too high, and thus, problems such as the degradation of the developing ability tend to be caused. Additionally, according to need, reduction may be conducted before the oxidation treatment.

<Electrophotographic Developer Carrier According to the Present Invention>

The electrophotographic developer carrier according to the present invention is prepared by coating the surface of the carrier core material with a resin.

The resin-coated carrier for an electrophotographic developer according to the present invention is preferably such that the resin-coating amount is preferably 0.1 to 10% by weight in relation to the carrier core material. When the resin coating amount is less than 0.01% by weight, it is difficult to form a uniform coating film layer on the surface of the carrier. When the resin coating amount exceeds 10% by weight, the mutual aggregation of the carrier particles occurs to offer the causes for the productivity degradation including the process yield decrease, and the causes for the variation of the properties of the developer in the actual machine such as the fluidity and the charge amount.

The coating film forming resin used herein can be appropriately selected according to the toner to be combined with the carrier, and the use environment and the like. No particular constraint is imposed on the type of the coating film forming resin; however, examples of the coating film forming resin include fluororesin, acrylic resin, epoxy resin, polyamide resin, polyamideimide resin, polyester resin, unsaturated polyester resin, urea resin, melamine resin, alkyd resin, phenolic resin, fluoroacrylic resin, acryl-styrene resin, silicone resin, and modified silicone resins prepared by modifying with resins such as acrylic resin, polyester resin, epoxy resin, polyamide resin, polyamideimide resin, alkyd resin, urethane resin and fluororesin. In consideration of the resin detachment due to the mechanical stress exerted during use, thermosetting resins are preferably used. Specific examples of the thermosetting resin include epoxy resin, phenolic resin, silicone resin, unsaturated polyester resin, urea resin, melamine resin, alkyd resin and the resins including these resins.

Additionally, for the purpose of controlling the electric resistivity, charge amount and charging rate of the carrier, a conductive agent can be added in the coating film forming resin. The electric resistivity of the conductive agent itself is low, and hence when the addition amount of the conductive agent is too large, a rapid charge leakage tends to occur. Accordingly, the addition amount of the conductive agent is 0.25 to 20.0% by weight, preferably 0.5 to 15.0% by weight and particularly preferably 1.0 to 10.0% by weight in relation to the solid content of the coating film forming resin. Examples of the conductive agent include conductive carbon, oxides such as titanium oxide and tin oxide, and various organic conductive agents.

Additionally, a charge controlling agent can be contained in the coating film forming resin. Examples of the charge controlling agent include various types of charge controlling agents and silane coupling agents generally used in toners. This is because in a case where the coating film formation controls the exposed area of the core material so as to be relatively small, the charge imparting ability is degraded as the case may be, but the addition of various types of charge controlling agents and silane coupling agents enables the control of the degradation of the charge imparting ability. No particular constraint is imposed on the usable various types of charge controlling agents and silane coupling agents; preferable examples of the usable charge controlling agents and silane coupling agents include: charge controlling agents such as nigrosin dyes, quaternary ammonium salts, organometallic complexes and metal-containing monoazo dyes; and aminosilane coupling agents and fluorine silane coupling agents.

(Measurement of Charge Amount)

In the measurement concerned, 3 g of a commercially available toner having a volume average particle size of 7.1 μm and 47 g of the carrier are weighed out, placed in a 50-cc glass bottle, and stirred and mixed by using a ball mill with the number of rotations of the glass bottle set at 100 rotations. After the rotation times of 1 minute, 5 minutes and 30 minutes from the start of the stirring, the developer is sampled and the charge amounts are measured with a blow-off charge amount measurement apparatus TB-200 manufactured by Toshiba Chemicals Co., Ltd.

<Method for Producing the Carrier Core Material for an Electrophotographic Developer and the Carrier According to the Present Invention>

Next, description is made on the method for producing the carrier core material for an electrophotographic developer and the resin-coated carrier according to the present invention.

The method for producing the carrier core material for an electrophotographic developer according to the present invention obtains the carrier core material as follows: the granulated substance obtained by preparing carrier raw materials is subjected to a thermal spraying in the air and then rapidly cooled and solidified, and thus the carrier core material is obtained.

No particular constraint is imposed on the method for preparing the granulated substance by using a carrier raw material, and heretofore known methods can be adopted; either a dry method or a wet method may be adopted.

In an example of the method for preparing a granulated substance, appropriate amounts of raw materials are weighed out, and then water is added to the weighed raw materials, the raw materials are pulverized to prepare a slurry, the prepared slurry is granulated with a spray dryer and the granulated substance thus obtained is classified to prepare a granulated substance having a predetermined particle size. The particle size of the granulated substance is preferably approximately 20 to 150 μm in consideration of the particle size of the carrier to be obtained. Additionally, in another example, the raw materials are weighed out, then mixed and dry pulverized to pulverize and disperse the individual raw materials; the mixture thus obtained is granulated with a granulator, the granulated substance thus obtained is classified to prepare a granulated substance having a predetermined particle size.

The granulated substance thus prepared is subjected to a thermal spraying in the air. For the thermal spraying, a combustion gas and oxygen are used for the flammable gas combustion flame, and the volume ratio of the combustion gas to oxygen is set at 1:3.5 to 1:6.0; the ratio of oxygen to the combustion gas in the flammable gas combustion flame is less than 3.5, the melting is insufficient, and when the ratio of oxygen to the combustion gas exceeds 6.0, ferritization is difficult. For example, oxygen is used in a ratio of 35 to 60 $Nm^3$/hr of oxygen to 10 $Nm^3$/hr of the combustion gas.

As the combustion gas used in the thermal spraying, gases such as propane gas, propylene gas and acetylene gas are used; in particular, propane gas is preferably used. Additionally, as the granulated substance conveying gas, nitrogen, oxygen or air is used. The flow rate of the granulated substance is preferably 20 to 60 m/sec.

In this connection, the flame temperature of the burner used in the thermal spraying is preferably set at 1500 to 3000° C., and the flame passage time is preferably set within 10 seconds.

The particles thus obtained by thermal spraying are placed in the air or in water to be rapidly cooled and solidified.

Thereafter, the particles are collected, dried and classified to yield a carrier core material. As the classification method, the existing methods such as a pneumatic classification method, a mesh filtration method and a precipitation method are used to regulate the particle size to a desired particle size. When a dry collection is conducted, the collection can also be conducted with a device such as a cyclone.

Thereafter, according to need, an oxide coating film treatment is applied by low-temperature heating of the surface, and thus the electric resistivity regulation can be conducted. The oxide coating film treatment is conducted as a heat treatment, for example, at 300 to 700° C. by using a furnace such as a common rotary electric furnace and a batch electric furnace.

In the electrophotographic developer carrier of the present invention, the surface of the carrier core material is coated with the above-described resin to form a resin coating film. The coating can be conducted by using as the coating method heretofore known methods such as a brush coating method, a spray dry method using a fluidized bed, a rotary dry method and a liquid immersion dry method using a universal stirrer. For the purpose of improving the coverage factor, preferable is a method using a fluidized bed.

When sintering is conducted after the carrier core material has been coated with the resin, either an external heating method or an internal heating method may be applied; for example, the sintering may be conducted with a fixed-type or flow-type electric furnace, a rotary electric furnace or a burner furnace, or a sintering with microwave may also be applied. When a UV curing resin is used, a UV heater is used. The sintering temperature is varied depending on the resin to be used, and is required to be equal to or higher than the melting point or the glass transition point of the resin to be used; in the cases of the resins such as thermosetting resins or condensation crosslinking resins, the temperature is required to be increased up to a temperature at which the curing proceeds to an sufficient extent.

<Electrophotographic Developer According to the Present Invention>

Next, description is made on the electrophotographic developer according to the present invention.

The electrophotographic developer according to the present invention is composed of the above-described electrophotographic developer carrier and a toner.

Examples of the toner particle constituting the electrophotographic developer of the present invention include a pulverized toner particle produced by a pulverization method and a polymerized toner particle produced by a polymerization method. In the present invention, the toner particle obtained by either of these methods can be used.

The pulverized toner particle can be obtained, for example, by means of a method in which a binder resin, a charge controlling agent and a colorant are fully mixed together with a mixing machine such as a Henschel mixer, then the mixture thus obtained is melt kneaded with an apparatus such as a double screw extruder, and the melt-kneaded substance is cooled, pulverized and classified, added with an external additive, and thereafter mixed with a mixing machine such as a mixer to yield the pulverized toner particle.

No particular constraint is imposed on the binder resin constituting the pulverized toner particle. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge controlling agent, any charge controlling agent can be used. Examples of the charge controlling agent for use in positively charged toners may include nigrosin dyes and quaternary ammonium salts. Additionally, examples of the charge controlling agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsion method. Such a polymerized toner particle can be obtained, for example, as follows: a colorant dispersion liquid in which a colorant is dispersed in water with a surfactant, a polymerizable monomer, a surfactant and a polymerization initiator are mixed together in a aqueous medium under stirring to disperse the polymerizable monomer by emulsification in the aqueous medium; the polymerizable monomer thus dispersed is polymerized under stirring for mixing; thereafter, the polymer particles are salted out by adding a salting-out agent; the particles obtained by salting-out is filtered off, rinsed and dried, and thus the polymerized toner particle can be obtained. Thereafter, according to need, an external additive is added to the dried toner particle.

Further, when the polymerized toner particle is produced, in addition to the polymerizable monomer, the surfactant, the polymerization initiator and the colorant, a fixability improving agent and a charge controlling agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

No particular constraint is imposed on the polymerizable monomer used in the production of the polymerized toner particle: however, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using silane coupling agents or titanium coupling agents.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. The used amount of such a surfactant affects the dispersion stability of the monomer, and also affects the environment dependence of the obtained polymerized toner particle, and hence such a surfactant is preferably used within the above-described range in which the dispersion stability of the monomer is ensured and the environment dependence of the polymerized toner particle is hardly affected in an excessive manner.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include natural waxes such as carnauba wax and olefin waxes such as polypropylene wax and polyethylene wax.

Additionally, for a case where the polymerized toner particle used in the present invention contains a charge controlling agent, no particular constraint is imposed on the charge controlling agent used, and examples of the usable charge controlling agent include nigrosin dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The average particle size of the toner particle produced as described above falls in a range from 2 to 15 μm and preferably in a range from 3 to 10 μm, and the polymerized toner particle is higher in the particle uniformity than the pulverized toner particle. When the average particle size of the toner particle is smaller than 2 μm, the charging ability is degraded to tend to cause fogging or toner scattering; when larger than 15 μm, such a particle size offers a cause for image quality degradation.

Mixing of the carrier and the toner produced as described above can yield an electrophotographic developer. The mixing ratio between the carrier and the toner, namely, the toner concentration is preferably set at 3 to 15%. When the toner concentration is less than 3%, it is difficult to attain a desired image density; when larger than 15%, toner scattering or fogging tends to occur.

The electrophotographic developer, according to the present invention, mixed as described above can be used in a digital image formation apparatus, such as a copying machine, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is described specifically with reference to Examples and others.

EXAMPLE 1

$Fe_2O_3$, $Mg(OH)_2$ and $TiO_2$ were weighed out so as to give a molar ratio of 8.25 moles:3.5 moles:2.5 moles, to prepare a mixture. To the mixture thus prepared, water, a binder component and a dispersant were added so as for the solid content to be 50%. The mixture thus obtained was pulverized with a bead mill for 2 hours, thereafter granulated with a spray dryer, and calcined at 1150° C. in air. The calcined substance was pulverized with a hammer crusher and the obtained calcined substance was made to pass at a feeding rate of 40 kg/hr through the flame to which 9.5 $Nm^3$/hr of propane and 47.5 $Nm^3$/hr of oxygen were supplied, and thus sintered substance was obtained. The sintered substance thus obtained was classified and subjected to a magnetic separation to yield a carrier core material having an average particle size of 27.51 μm.

EXAMPLE 2

A carrier core material having an average particle size of 24.73 μm was obtained in the same manner as in Example 1 except that $Fe_2O_3$, $Mg(OH)_2$ and $TiO_2$ were weighed out so as to give a molar ratio of 7.25 moles:3.5 moles:1.5 moles.

EXAMPLE 3

A carrier core material having an average particle size of 26.07 μm was obtained by oxidizing the surface of the core material obtained in Example 2, at 550° C. with a rotary kiln of 10 cm in diameter.

EXAMPLE 4

A carrier core material having an average particle size of 24.74 μm was obtained in the same manner as in Example 1 except that $Fe_2O_3$, $Mg(OH)_2$ and $TiO_2$ were weighed out so as to give a molar ratio of 6.25 moles:3.5 moles:0.5 mole.

EXAMPLE 5

The core material obtained in Example 4 was classified to yield a carrier core material having an average particle size of 34.96 μm.

EXAMPLE 6

A carrier core material having an average particle size of 25.58 μm was obtained by oxidizing the surface of the core material obtained in Example 4, at 550° C. with a rotary kiln of 10 cm in diameter.

EXAMPLE 7

A carrier core material having an average particle size of 26.33 μm was obtained in the same manner as in Example 1 except that $Fe_2O_3$, $Mg(OH)_2$ and $TiO_2$ were weighed out so as to give a molar ratio of 3.35 moles:1.0 mole:0.1 mole.

EXAMPLE 8

A carrier core material having an average particle size of 25.81 μm was obtained in the same manner as in Example 1 except that $Fe_2O_3$, $Mg(OH)_2$ and $TiO_2$ were weighed out so as to give a molar ratio of 4.35 moles:2.0 moles:0.1 mole.

EXAMPLE 9

A carrier core material having an average particle size of 78.55 μm was prepared in the same manner as in Example 1, and coated with an acrylic resin LR-269 manufactured by Mitsubishi Rayon Co., Ltd., used as a coating resin, by using a mixing stirrer. In this case, the resin solution used was a resin solution prepared by weighing the resin so as to be 0.5% in terms of the solid content of the resin in relation to the carrier core material, and by adding toluene so as for the solid content of the resin to be 10%. After coating with the resin, for the purpose of completely removing the volatile components, the resin-coated substance was dried with a hot air dryer set at 145° C. for 2 hours to yield a resin-coated carrier.

EXAMPLE 10

A resin-coated carrier was obtained in the same manner as in Example 9 except that the solid content of the resin in relation to the carrier core material was set at 1.5% and the resin coating was conducted with a fluidized bed coating apparatus.

EXAMPLE 11

A carrier core material having an average particle size of 78.55 μm was prepared in the same manner as in Example 1, and coated with a silicone resin SR-2411 manufactured by Toray Silicone Co., Ltd., used as a coating resin, by using a fluidized bed coating apparatus. In this case, the resin solution used was a resin solution prepared by weighing the resin so as to be 1.5% in terms of the solid content of the resin in relation to the carrier core material, and by adding toluene so as for the solid content of the resin to be 10%. After coating with the resin, for the purpose of completely removing the volatile components, the resin-coated substance was dried with a hot air dryer set at 220° C. for 3 hours to yield a resin-coated carrier.

COMPARATIVE EXAMPLE 1

A carrier core material having an average particle size of 25.02 μm was obtained in the same manner as in Example 1 except that $Fe_2O_3$, $Mg(OH)_2$ and $TiO_2$ were weighed out so as to give a molar ratio of 4.25 moles:1.5 moles:2.5 moles.

COMPARATIVE EXAMPLE 2

A carrier core material having an average particle size of 25.21 μm was obtained in the same manner as in Example 1 except that $Fe_2O_3$ and $Mg(OH)_2$ were weighed out so as to give a molar ratio of 1.0 mole:1.0 mole.

COMPARATIVE EXAMPLE 3

A carrier core material having an average particle size of 24.88 μm was obtained in the same manner as in Example 1 except that $Fe_2O_3$ and $Mg(OH)_2$ were weighed out so as to give a molar ratio of 4.0 moles:1.0 mole.

COMPARATIVE EXAMPLE 4

A carrier core material having an average particle size of 25.33 μm was obtained in the same manner as in Example 1 except that $Fe_2O_3$ and $TiO_2$ were weighed out so as to give a molar ratio of 1.0 mole:0.5 mole.

COMPARATIVE EXAMPLE 5

A carrier core material having an average particle size of 25.71 μm was obtained in the same manner as in Example 1 except that $Fe_2O_3$ and $TiO_2$ were weighed out so as to give a molar ratio of 8.0 moles:0.5 mole.

COMPARATIVE EXAMPLE 6

A carrier core material having an average particle size of 24.91 μm was obtained in the same manner as in Example 1 except that the raw material was limited to $Fe_2O_3$.

COMPARATIVE EXAMPLE 7

A carrier core material having an average particle size of 24.82 μm was obtained in the same manner as in Example 1 except that $Fe_2O_3$, $Mg(OH)_2$ and $TiO_2$ were weighed out so as to give a molar ratio of 7.25 moles:1.5 moles:2.0 moles.

The production conditions (mixing numbers of moles, pretreatment, thermal spraying conditions, post-treatment) in Examples 1 to 8 and Comparative Examples 1 to 7 are shown in Table 1. The various property values (chemical analysis values, X-ray diffraction, average sphericity ratio, particle size distribution, apparent density, fluidity, magnetic properties and resistivity) in Examples 1 to 8 and Comparative Examples 1 to 7 are shown in Tables 2 and 3. Additionally, the various property values (resistivity and charge amount) in Examples 9 to 11 were evaluated and the results thus obtained are shown in Table 4.

TABLE 1

| | Mixing numbers of moles | | | Pretreatment | Thermal spraying | | | | Post-treatment Oxidation |
|---|---|---|---|---|---|---|---|---|---|
| | $Fe_2O_3$ | $Mg(OH)_2$ | $TiO_2$ | Calcination | Propane ($Nm^3$/hr) | Oxygen ($Nm^3$/hr) | Powder feeding oxygen ($Nm^3$/hr) | Powder feeding rate (Kg/hr) | surface treatment (resistvity increase) |
| Ex. 1 | 8.25 | 3.50 | 2.50 | 1150° C. | 9.5 | 36 | 11.5 | 40 | Not applied |
| Ex. 2 | 7.25 | 3.50 | 1.50 | 1150° C. | 9.5 | 36 | 11.5 | 40 | Not applied |
| Ex. 3 | 7.25 | 3.50 | 1.50 | 1150° C. | 9.5 | 36 | 11.5 | 40 | 550° C. |
| Ex. 4 | 6.25 | 3.50 | 0.50 | 1150° C. | 9.5 | 36 | 11.5 | 40 | Not applied |
| Ex. 5 | 6.25 | 3.50 | 0.50 | 1150° C. | 9.5 | 36 | 11.5 | 40 | Not applied |
| Ex. 6 | 6.25 | 3.50 | 0.50 | 1150° C. | 9.5 | 36 | 11.5 | 40 | 550° C. |
| Ex. 7 | 3.35 | 1.00 | 0.10 | 1150° C. | 9.5 | 36 | 11.5 | 40 | Not applied |
| Ex. 8 | 4.35 | 2.00 | 0.10 | 1150° C. | 9.5 | 36 | 11.5 | 40 | Not applied |
| Com. Ex. 1 | 4.25 | 1.50 | 2.50 | 1150° C. | 9.5 | 36 | 11.5 | 40 | Not applied |
| Com. Ex. 2 | 1.00 | 1.00 | 0.00 | 1150° C. | 9.5 | 36 | 11.5 | 40 | Not applied |
| Com. Ex. 3 | 4.00 | 1.00 | 0.00 | 1150° C. | 9.5 | 36 | 11.5 | 40 | Not applied |
| Com. Ex. 4 | 1.00 | 0.00 | 0.50 | 1150° C. | 9.5 | 36 | 11.5 | 40 | Not applied |
| Com. Ex. 5 | 8.00 | 0.00 | 0.50 | 1150° C. | 9.5 | 36 | 11.5 | 40 | Not applied |
| Com. Ex. 6 | 1.00 | 0.00 | 0.00 | 1150° C. | 9.5 | 36 | 11.5 | 40 | Not applied |
| Com. Ex. 7 | 7.25 | 1.50 | 2.00 | 1150° C. | 9.5 | 36 | 11.5 | 40 | Not applied |

TABLE 2

| | Chemical analysis (ICP) (wt %) | | | Results of X-ray diffraction | | | Average sphericity |
|---|---|---|---|---|---|---|---|
| | Fe | Mg | Ti | Spinel structure | Nonspinel structures ($Fe_2O_3$, $Fe_2TiO_5$, $FeTiO_3$ structures) | Nonspinel structures (other than $Fe_2O_3$, $Fe_2TiO_5$, $FeTiO_3$ structures) | ratio Circumscribed circle diameter/inscribed circle diameter |
| Ex. 1 | 56.0 | 5.2 | 7.3 | Present | Present | Absent | 1.06 |
| Ex. 2 | 57.6 | 6.0 | 5.1 | Present | Present | Absent | 1.08 |
| Ex. 3 | — | — | — | Present | Present | Absent | 1.08 |
| Ex. 4 | 59.8 | 7.3 | 2.1 | Present | Present | Absent | 1.05 |
| Ex. 5 | — | — | — | Present | Present | Absent | 1.06 |
| Ex. 6 | — | — | — | Present | Present | Absent | 1.05 |
| Ex. 7 | 65.5 | 4.3 | 0.8 | Present | Present | Absent | 1.09 |
| Ex. 8 | 63.0 | 6.3 | 0.6 | Present | Present | Absent | 1.1 |
| Com. Ex. 1 | 50.6 | 3.9 | 12.8 | Present | Present | Absent | 1.08 |
| Com. Ex. 2 | 55.9 | 12.2 | 0.0 | Present | Absent | Present | 1.06 |
| Com. Ex. 3 | 67.4 | 3.7 | 0.0 | Present | Absent | Absent | 1.07 |
| Com. Ex. 4 | 56.7 | 0.0 | 12.2 | Absent | Present | Absent | 1.08 |
| Com. Ex. 5 | 69.9 | 0.0 | 1.9 | Present | Present | Absent | 1.1 |
| Com. Ex. 6 | 72.3 | 0.0 | 0.0 | Present | Absent | Absent | 1.08 |
| Com. Ex. 7 | 59.6 | 2.7 | 7.0 | Present | Present | Absent | 1.06 |

TABLE 3

| | Apparent density ($g/cm^3$) | Fluidity (sec/50 g) | VSM (@1 kOe) Ms ($Am^2/kg$) | Mr ($Am^2/kg$) | Hc (Oe) | Average particle size D50 (um) | Bridge, 6.5-mm gap (Ω) 100 V | 250 V | 500 V | 1000 V |
|---|---|---|---|---|---|---|---|---|---|---|
| Ex. 1 | 2.59 | 37.2 | 32.5 | 3.2 | 64.6 | 27.51 | $2.2 \times 10^8$ | $2.1 \times 10^8$ | $1.6 \times 10^8$ | Unmeasurable |
| Ex. 2 | 2.52 | 69.9 | 33.1 | 3.6 | 64.2 | 24.73 | $9.4 \times 10^7$ | $9.0 \times 10^7$ | $1.1 \times 10^8$ | $6.6 \times 10^6$ |
| Ex. 3 | 2.51 | 33.6 | 29.8 | 3.7 | 66.1 | 26.07 | $9.8 \times 10^8$ | $9.8 \times 10^8$ | $9.7 \times 10^8$ | $9.8 \times 10^8$ |
| Ex. 4 | 2.50 | 64.6 | 43.6 | 3.0 | 42.7 | 24.74 | $6.7 \times 10^7$ | $5.9 \times 10^7$ | $7.1 \times 10^7$ | Unmeasurable |
| Ex. 5 | 2.53 | 30.6 | 45.7 | 2.8 | 39.5 | 34.96 | $5.4 \times 10^7$ | $4.8 \times 10^7$ | $4.8 \times 10^7$ | Unmeasurable |
| Ex. 6 | 2.50 | 35.0 | 35.7 | 2.8 | 38.9 | 25.58 | $7.2 \times 10^8$ | $6.9 \times 10^8$ | $7.2 \times 10^8$ | $8.2 \times 10^8$ |
| Ex. 7 | 2.56 | 36.1 | 53.7 | 2.5 | 35.7 | 26.33 | $4.4 \times 10^8$ | $3.8 \times 10^8$ | $6.8 \times 10^7$ | Unmeasurable |
| Ex. 8 | 2.53 | 34.8 | 51.7 | 2.3 | 32.1 | 25.81 | $4.8 \times 10^7$ | $4.5 \times 10^7$ | $7.8 \times 10^6$ | Unmeasurable |
| Com. Ex. 1 | 2.50 | No flow | 13.6 | 2.1 | 76.8 | 25.02 | $3.5 \times 10^7$ | $3.2 \times 10^7$ | $1.8 \times 10^6$ | $8.7 \times 10^7$ |
| Com. Ex. 2 | 2.51 | No flow | 28.0 | 8.5 | 113.1 | 25.21 | $1.9 \times 10^{10}$ | $1.7 \times 10^{10}$ | $1.2 \times 10^{10}$ | $3.7 \times 10^9$ |
| Com. Ex. 3 | 2.54 | 38.1 | 61.6 | 5.3 | 23.8 | 24.88 | $3.2 \times 10^7$ | $2.4 \times 10^6$ | Unmeasurable | Unmeasurable |
| Com. Ex. 4 | 2.51 | No flow | 4.5 | 12.3 | 145.2 | 25.33 | $3.9 \times 10^9$ | $3.7 \times 10^9$ | $3.2 \times 10^9$ | $6.7 \times 10^8$ |
| Com. Ex. 5 | 2.54 | No flow | 69.1 | 4.2 | 81.1 | 25.71 | $3.5 \times 10^7$ | Unmeasurable | Unmeasurable | Unmeasurable |
| Com. Ex. 6 | 2.54 | 35.4 | 76.0 | 4.1 | 48.9 | 24.91 | $2.1 \times 10^6$ | Unmeasurable | Unmeasurable | Unmeasurable |
| Com. Ex. 7 | 2.59 | No flow | 23.4 | 3.3 | 86.3 | 24.82 | $2.5 \times 10^7$ | $2.5 \times 10^7$ | $2.8 \times 10^7$ | $6.6 \times 10^6$ |

| | Microtrac +88 μm | about 62 μm | about 44 μm | about 31 μm | about 22 μm | about 16 μm | −16 μm |
|---|---|---|---|---|---|---|---|
| Ex. 1 | 0.00 | 0.37 | 3.73 | 26.28 | 55.21 | 14.27 | 0.14 |
| Ex. 2 | 0.00 | 0.01 | 2.19 | 16.30 | 50.63 | 27.02 | 3.85 |
| Ex. 3 | 0.00 | 0.01 | 2.51 | 20.37 | 55.97 | 19.94 | 1.20 |
| Ex. 4 | 0.00 | 0.01 | 2.13 | 16.20 | 51.04 | 26.90 | 3.72 |
| Ex. 5 | 0.00 | 1.79 | 15.08 | 54.38 | 27.56 | 1.19 | 0.00 |
| Ex. 6 | 0.00 | 0.01 | 2.30 | 18.50 | 55.08 | 22.50 | 1.61 |
| Ex. 7 | 0.00 | 0.19 | 3.02 | 22.39 | 55.15 | 18.38 | 0.87 |
| Ex. 8 | 0.00 | 0.10 | 2.76 | 21.38 | 55.56 | 19.16 | 1.04 |
| Com. Ex. 1 | 0.00 | 0.01 | 3.21 | 17.00 | 53.25 | 25.47 | 1.06 |
| Com. Ex. 2 | 0.00 | 0.01 | 2.76 | 17.96 | 54.97 | 23.46 | 0.84 |
| Com. | 0.00 | 0.03 | 2.27 | 16.91 | 53.08 | 26.16 | 1.55 |

TABLE 3-continued

| | | | | | | | |
|---|---|---|---|---|---|---|---|
| Ex. 3 | | | | | | | |
| Com. Ex. 4 | 0.00 | 0.08 | 2.45 | 19.35 | 53.05 | 23.97 | 1.11 |
| Com. Ex. 5 | 0.00 | 0.01 | 2.34 | 19.02 | 55.05 | 21.81 | 1.78 |
| Com. Ex. 6 | 0.00 | 0.01 | 2.63 | 15.95 | 55.79 | 24.90 | 0.72 |
| Com. Ex. 7 | 0.00 | 0.01 | 1.93 | 15.88 | 52.89 | 26.17 | 3.12 |

TABLE 4

| | Bridge, 6.5-mm gap (Ω) | | | | Charge amount measurement results (μc/g) | | |
|---|---|---|---|---|---|---|---|
| | 100 V | 250 V | 500 V | 1000 V | 1 min | 5 min | 30 min |
| Ex. 9 | $1.6 \times 10^{11}$ | $1.4 \times 10^{11}$ | $1.2 \times 10^{11}$ | $1.1 \times 10^{11}$ | −33.7 | −43.7 | −43.9 |
| Ex. 10 | $6.3 \times 10^{11}$ | $4.5 \times 10^{11}$ | $4.3 \times 10^{11}$ | $3.5 \times 10^{11}$ | −52.3 | −56.9 | −57.3 |
| Ex. 11 | $6.4 \times 10^{11}$ | $4.2 \times 10^{11}$ | $4.1 \times 10^{11}$ | $3.4 \times 10^{11}$ | −18.6 | −23.1 | −28.7 |

As shown in Tables 1 to 3, each of Examples 1 to 8 is extremely close to a spherical shape, and accordingly is high in fluidity, and additionally, has wide ranges of the magnetization control and the resistivity control although the truly spherical shape is maintained, and offers a carrier core material suitable for an electrophotographic carrier. On the contrary, although Comparative Examples 1 to 7 are all truly spherical in shape, Comparative Example 1 is low in magnetization and hence cannot be used as a carrier core material; each of Comparative Examples 2, 4, 5 and 7 is large in coercive force to be poor in fluidity and hence cannot be used as a carrier core material; and Comparative Example 3 is high in magnetization and too low in resistivity and hence cannot be used as a carrier core material.

Additionally, in each of Examples 9 to 11, as shown in Table 4, it has been verified that by coating with a resin, a sufficient resistivity as a carrier and a sufficient charging capability as a carrier can be attained.

The carrier core material for an electrophotographic developer and the carrier according to the present invention each attain, without using Mn as well as various heavy metals, a desired resistivity in combination with a low magnetization, have a coercive force of the order of magnitude not to affect the fluidity, and have a satisfactory fluidity. And, the electrophotographic developer using the carrier prevents the carrier adhesion.

Consequently, the present invention can be widely used particularly in the fields associated with full-color machines required to be high in image quality and high speed machines required to be satisfactory in the reliability and durability in image maintenance.

CROSS-REFERENCE TO RELATED APPLICATIONS

The present application claims priority under 35 U.S.C. §119 of Japanese Patent Application No. 2008-020030, filed Jan. 31, 2008, the disclosure of which is expressly incorporated by reference herein in its entirety.

What is claimed is:

1. A carrier core material for an electrophotographic developer, comprising Mg, Ti and Fe as main components, and including Fe, Mg and Ti in contents of 52 to 66% by weight, 3 to 12% by weight and 0.2 to 12% by weight, respectively.

2. The carrier core material for an electrophotographic developer according to claim 1, wherein the saturation magnetization as measured with a VSM at 1 kOe is 30 to 60 $Am^2/kg$, the remanent magnetization is 2 to 4 $Am^2/kg$ and the coercive force is 25 to 75 Oe.

3. The carrier core material for an electrophotographic developer according to claim 1, being truly spherical in shape.

4. The carrier core material for an electrophotographic developer according to claim 1, wherein when the bridge electric resistvity values for a 6.5-mm gap at applied voltages of 100 V and 500 V are respectively represented by $R_{100}$ and $R_{500}$, $R_{100}$ is $5\times10^6$ to $1\times10^{10}\Omega$ and $R_{500}$ is $5\times10^6$ to $1\times10^{10}\Omega$.

5. The carrier core material for an electrophotographic developer according to claim 1, wherein the volume average particle size $D_{50}$ as measured with a laser diffraction particle size distribution analyzer is 20 to 100 μm.

6. The carrier core material for an electrophotographic developer according to claim 1, produced by passing through a step of thermal spraying.

7. The carrier core material for an electrophotographic developer according to claim 1, wherein an oxide coating film is formed on the surface of the carrier core material.

8. An electrophotographic developer carrier prepared by coating with a resin the carrier core material according to claim 1.

9. An electrophotographic developer comprising the carrier according to claim 8 and a toner.

10. An electrophotographic developer carrier prepared by coating with a resin the carrier core material according to claim 2.

11. An electrophotographic developer comprising the carrier according to claim 10 and a toner.

12. An electrophotographic developer carrier prepared by coating with a resin the carrier core material according to claim 3.

13. An electrophotographic developer comprising the carrier according to claim 12 and a toner.

14. An electrophotographic developer carrier prepared by coating with a resin the carrier core material according to claim 4.

15. An electrophotographic developer comprising the carrier according to claim 14 and a toner.

16. An electrophotographic developer carrier prepared by coating with a resin the carrier core material according to claim 5.

17. An electrophotographic developer comprising the carrier according to claim 16 and a toner.

18. An electrophotographic developer carrier prepared by coating with a resin the carrier core material according to claim 7.

19. An electrophotographic developer comprising the carrier according to claim 18 and a toner.

* * * * *